United States Patent [19]

Jarman et al.

[11] 4,201,076

[45] May 6, 1980

[54] FRONT END ALIGNMENT SYSTEM

[76] Inventors: Davis R. Jarman, 612 Ward Dr.; Virgil H. Hinson, 206 Fairway Oaks Dr., both of Brunswick, Ga. 31520

[21] Appl. No.: 915,808

[22] Filed: Jun. 15, 1978

[51] Int. Cl.[2] ..... B21D 1/12; B21D 25/00

[52] U.S. Cl. ..... 72/392; 72/704; 72/705

[58] Field of Search ..... 72/704, 705, 302, 392

[56] References Cited

U.S. PATENT DOCUMENTS

| | | | |
|---|---|---|---|
| 2,715,431 | 8/1955 | Grossu | 72/302 X |
| 2,999,528 | 9/1961 | Kurtak | 72/302 X |
| 3,214,959 | 11/1965 | Bowden | 72/705 X |
| 3,276,237 | 10/1966 | Transue | 72/705 X |
| 3,452,575 | 7/1969 | Williams | 72/705 X |
| 3,689,030 | 9/1972 | Backus | 72/705 X |
| 3,796,084 | 3/1974 | Jarman | 72/705 X |
| 4,103,531 | 8/1978 | Daniel | 72/704 X |
| 4,117,709 | 10/1978 | Jackson | 72/704 X |
| 4,138,876 | 2/1979 | Chisum | 72/705 X |

FOREIGN PATENT DOCUMENTS 2227849 12/1973 Fed. Rep. of Germany ..... 72/705

*Primary Examiner*—Daniel C. Crane
*Assistant Examiner*—D. M. Gurley
*Attorney, Agent, or Firm*—Clarence A. O'Brien; Harvey B. Jacobson

[57] ABSTRACT

An alignment system for non-adjustable motor vehicle front end suspensions, such as those employing McPherson struts, has a support assembly anchorable relative to an adjacent vehicle being repaired, with a connector arrangement provided on the support assembly for permitting one of the struts to be restrained relative to the support assembly while the other of the struts is being pulled into proper position. Once the struts have been correctly positioned in accordance with factory specifications, the sheet metal forming the fender wells, and the like, can be welded or bolted in place while pressure is maintained on the struts so as to re-unitize the vehicle body portions with which the suspension system is employed.

4 Claims, 6 Drawing Figures

FRONT END ALIGNMENT SYSTEM

BACKGROUND OF THE INVENTION

1. Field of the Invention

This invention relates generally to alignment systems for the front end of motor vehicles, and particularly to a system for realigning motor vehicle front ends constructed with non-adjustable suspensions such as those employing McPherson struts.

2. Description of the Prior Art

The current trend towards smaller automobiles has resulted in development of a vehicle construction generally referred to as "uni-body" or unitized body construction. One of the features of such construction is the use of non-adjustable front end suspensions built around an upstanding elongated longitudinally extendable spring-biased strut anchored directly to the sheet metal of the vehicle body at the upper end and supporting one of the front wheels at the lower end. These struts are known generally as the McPherson strut. The use of such front end suspension systems, while currently restricted primarily to many popular models of cars of foreign manufacture, is expected to increase greatly in the next few years due to adoption of the unitized body mode of construction by United States automobile manufactures.

A disadvantage of the unitized body construction employing non-adjustable front end suspensions is that if the vehicle is afflicted with impact damage to the front end thereof, the struts must first be realigned before the body metal can be repaired and the unitized body construction restored, since it is the body metal itself which holds the struts in place on the vehicle. Currently, body and fender shops will either insert a fluid jack between the upper ends of the struts in order to push same apart, or will connect a turn buckle between such upper ends of the struts in order to pull the ends toward one another. These methods, however, are inherently inaccurate, and further are not capable of providing relative movement between the struts, which relative movement is often necessary to restore the struts to positions in accordance with factory specifications.

It is generally known to use either a fluid-operated or mechanical jack in a suitable manner to straighten vehicle frames and body metal. For example, U.S. Pat. No. 3,765,219, issued Oct. 16, 1973 to W. N. Easom, Jr. discloses a wheel alignment device which straightens wheel suspension beams and includes a bifurcated frame between the sides of which is pivotally mounted a fluid-operated or mechanical jack. Further, additional examples of body and frame pulling devices can be found in U.S. Pat. Nos. 3,577,881, issued May 11, 1971 to E. J. Markovics; 3,817,081, issued June 18, 1974 to R. Morski et al; and 3,835,692, issued Sept. 17, 1974 to R. B. Hoffman.

SUMMARY OF THE INVENTION

It is an object of the present invention to provide an alignment system for non-adjustable motor vehicle front end suspensions.

It is another object of the present invention to provide an alignment system for non-adjustable motor vehicle front end suspensions which can be used as part of an overall vehicle body and frame straightening system which employs one or more pull stands restrained by a continuous, floor anchored track.

Still another object of the present invention is to provide an alignment system for unitized body front end suspension systems, such as those employing McPherson struts, which permits individual and extremely accurate realignment of the struts so as to permit restoration to factory specifications of a motor vehicle of unitized body construction.

These and other objects are achieved according to the present invention by providing an alignment system having: a support assembly anchorable relative to an adjacent vehicle being repaired; a connector arrangement movably mounted on the support assembly for removable connection to an element, such as a McPherson struct, being straightened; and a pull device movably mounted on the support assembly and connectible to the connector arrangement for biasing the connector arrangement and moving the element being straightened a desired amount. The support assembly advantageously includes a pair of stands anchorable on a surface supporting the stands, the strands being arrangeable opposite one another, and a beam connected to and arranged extending between the stands so as to pass over the tops of the struts being straightened. Preferably, the support assembly further includes a continuous anchor track having a slot-forming flange and fixable to the support surface, such as the floor, of the area being used to repair vehicles, with the track being arranged for surroundingly receiving a vehicle being repaired. Each of the stands is provided with a tongue engageable in the slot-forming flange of the track and being restrained by the track from movement toward the vehicle.

The connector arrangement preferably includes a sleeve slidably disposed on the beam, and having an arm extending cantilever-fashion from the sleeve and connectible to a strut to be straightened. A collar is slidably mounted on the beam and adjustably attached to the sleeve, with the collar being provided with an opening and the beam being provided with a plurality of holes such that a pin can be engaged in the opening in a selected one of the holes for restraining the collar, and consequently the sleeve, for movement relative to the beam. Normally, there will be a pair of sets of such collars and sleeves, one for each of the struts normally provided in a non-adjustable front end suspension system of a motor vehicle. A conventional linear fluid motor is preferably employed as the pull device, with the motor being connectible to one of the stands and to one of the sleeves for permitting a pulling movement to be exerted on the sleeve in either direction to straighten the associated strut appropriately; the collar connected to the sleeve being pulled not being pinned to the beam, but the other of the collars being pinned to hold the strut associated therewith in a fixed position relative to the beam.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is an exploded, perspective view, showing the adapter plate by which pulling equipment according to the present invention is attached to the upper end of a McPherson strut, and the like.

DESCRIPTION OF THE PREFERRED EMBODIMENTS

Figure 1:
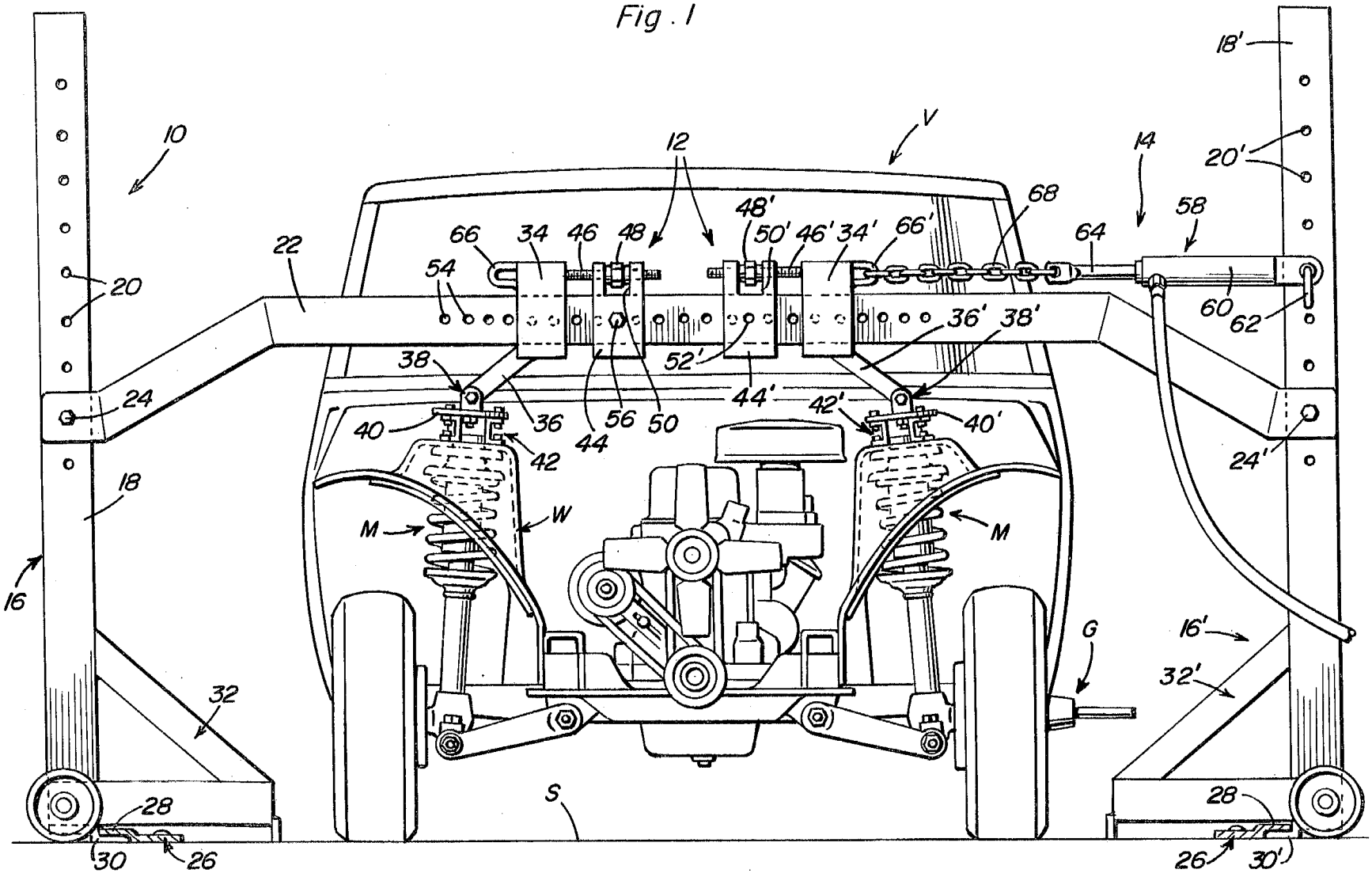
FIG. 1 is a schematic, front elevational view, showing an alignment system according to the present invention being employed for straightening the struts of a non-adjustable motor vehicle front end suspension.
Figure 2:
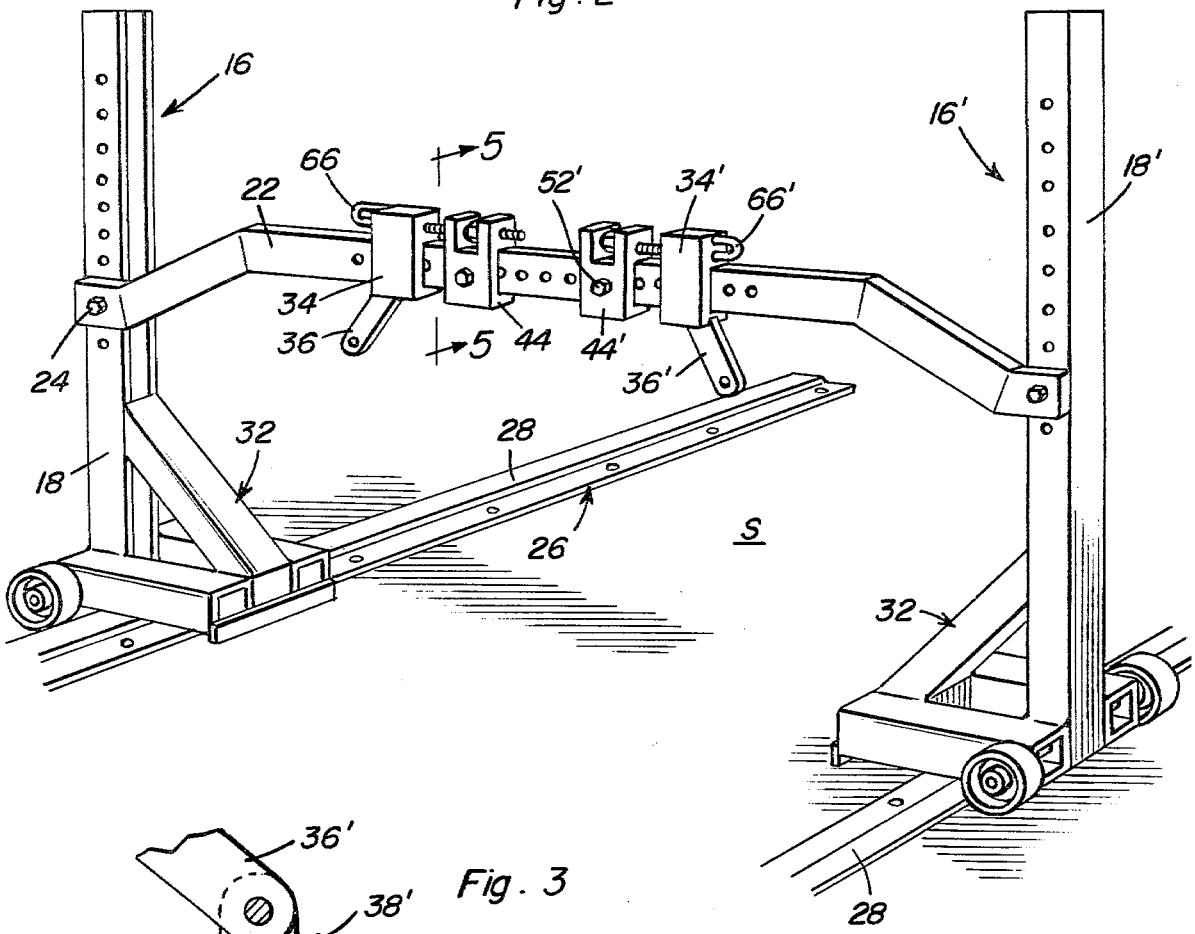
FIG. 2 is a schematic, perspective view showing the equipment employed in an alignment system according to the present invention.
Figure 3:
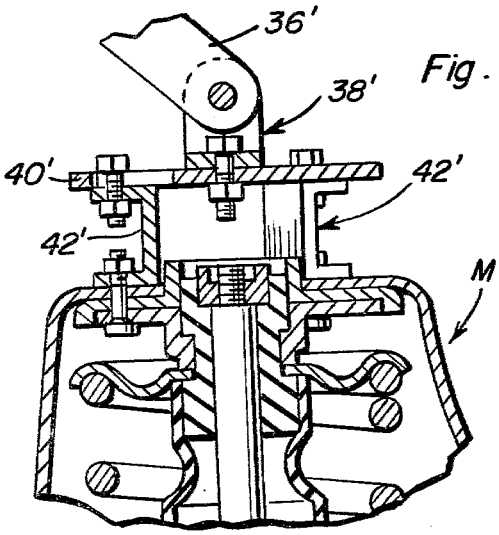
FIG. 3 is an enlarged, fragmentary, vertical sectional view showing the upper end of a McPherson strut and the manner of attachment thereof to pulling equipment according to the present invention.
Figure 5:
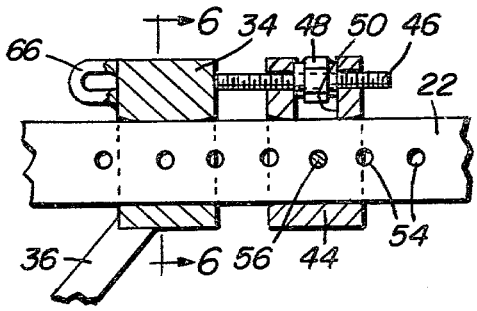
FIG. 5 is an enlarged, fragmentary, sectional view taken generally along the line 5—5 of FIG. 2.

Referring now more particularly to the Figures of the drawings, an alignment system according to the present invention includes a support assembly 10 anchored relative to a vehicle V being repaired, and adjustably supporting a connector arrangement 12 movably mounted on the support assembly 10 for removable connection to an element or elements, such as the McPherson struts M of vehicle V, being straightened. The struts M are of conventional construction, and in particular are modeled after those employed on recent model automobiles sold under the "Toyota" trademark. A pull device 14 is pivotally mounted on the support assembly 10 and connectible to connector arrangement 12 for biasing the connector arrangement 12 and moving the element being straightened a desired amount.

Support assembly 10 includes a pair of stands 16 and 16' anchorable on a surface S supporting stands 16, 16', the latter being arrangeable on opposite sides of motor vehicle V and each including a respective vertically upstanding post 18, 18'. Each of the posts 18, 18' is provided with a plurality of apertures 20, 20', and a beam 22 is connected to and arranged extending between the posts 18, 18' as by the illustrated pins 24, 24', which may be conventional bolts and nuts, and the like. In this manner, beam 22 can be arranged extending directly over the upper end portions of the McPherson struts M. The support assembly 10 further includes a continuous anchor track 26 having a slot-forming flange 28 opening outwardly thereof and secured to support surface S in a conventional manner, such as by suitable expanding anchors (not shown). The use of such a track as track 26, and associated stands 16, 16', is generally known in the body and frame straightening industry, and it is in conjunction with such a basic system that the alignment system according to the present invention is intended to be employed. Each of the stands 16, 16' has a tongue 30, 30' disposed in the bottom portion thereof for engagement in the slot formed by flange 28, with such tongue 30, 30' extending from the lower end of post 18, 18'. A base 32, 32' is associated at the lower end of post 18, 18' of each of the stands 16, 16', which base 32, 32' extends perpendicularly away from the extent of the associated post 18, 18' in order to engage the supporting surface S and prevent post 18, 18' from pivoting relative to track 26 in the direction of the moment being exerted on the post 18, 18' by a pulling force to be exerted on the associated stand 16, 16' as to be described below.

Connector arrangement 12 includes two sets of coupling elements each including a sleeve 34, 34' slidably disposed on beam 22 and having an arm 36, 36' extending cantilever-fashion from sleeve 34 and connectible to the upper end of a strut end to be straightened. Connection of each arm 36, 36' is accomplished by use of a U-shaped swivel bracket 38, 38' pinned to the lower end of the associated arm 36, 36' and connectible to an associated adapter plate 40, 40' as by the illustrated nut and bolt. The adapter plates 40, 40' are mounted on the upper end of the McPherson struts M as by the use of the generally C-shaped spacing brackets 42, 42' which have a pair of opposed legs, one of which legs is secured to the studs conventionally provided at the upper ends of the struts M, and the other of which legs is suitably bolted to a hole or slot provided in the adapter plate 40, 40'. The spacing brackets 42, 42' are employed in order to space the associated adapter plate 40, 40' above the head end of the respective strut M and eliminate any possible obstruction with the boss and other structure at such head end of the strut M.

Each set of connector elements of connector arrangement 12 further includes a collar 44, 44' slidably mounted on beam 22 and adjustably attached to the associated sleeve 34, 34' as by the illustrated threaded rod 46, 46' engaged in a nut 48, 48' disposed in a recess 50, 50' provided in the upper portion of the associated collar 44, 44'. By anchoring the rod 46, 46' in the respective sleeve 34, 34', adjustment of the distance between the collar 44, 44' and the sleeve 34, 34' can be readily made by rotation of the associated nut 48, 48'. Each of the collars 44, 44' is provided with a respective opening 52 which can be brought into mating relationship with one of a plurality of holes 54 spaced along the extent of beam 22, and permit a pin 56, such as a conventional bolt and nut, to be inserted through opening 52 in one of the holes 54 in order to retain collar 44, 44' in a fixed position relative to beam 22, as desired. The adjustment of the distance between the collar 44, 44' and associated sleeve 34, 34' facilitates matching of the opening 52 of a collar 44, 44' with one of the holes 54 provided in beam 22.

Pull device 14 includes a linear motor 58 pivotally connectible to a one of the stands 16, 16' and one of the collars 44, 44' of one of the sets of sleeves and collars for pulling the collar, and an associated sleeve 34, 34', in a desired direction. While this direction must necessarily be toward one of the stands 16, 16' to which motor 58 is connected by pivotal attachment of cylinder 60 and motor 58 by a pin 62 removably received in one of the apertures 20 20', it will be appreciated that piston rod 64 of motor 58 can be attached to either eye 66, 66' provided on sleeves 34, 34', respectively, in order to permit the struts M to be moved in either direction desired to restore the strut S to its proper position. A length of chain 68 is attached to the end of piston rod 64 in order to effect the actual attachment of motor 58 to one of the eyes 66 and 66' in order to permit variation in the distance between the particular sleeve 34, 34' and the one of the stands 16, 16' on which motor 58 is mounted.

Figure 4:
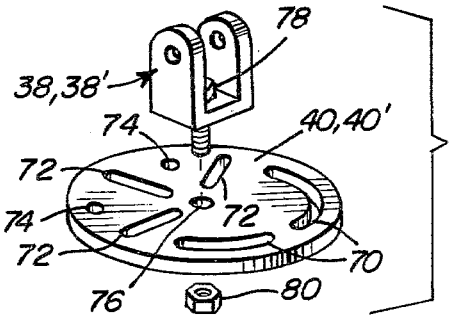
Figure 6:
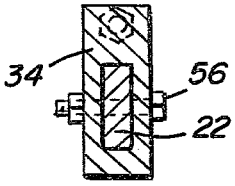
FIG. 6 is a sectional view taken generally along the line 6—6 of FIG. 5.

As can best be seen in FIG. 4, each of the adapter plates 40, 40' is a planar disk having a circular periphery and provided with, for example, a pair of adjacent, curved slots 70 conforming generally to the curve of the circumference of the disk, and three radially extending slots 72. Disposed between the slots 72 are a pair of holes 74, while an aperture 76 is provided centrally of the disk. This aperture 76 can receive a bolt 78 and associated nut 80 for permitting attachment of adapter plate 40, 40' to a respective one of the swivel brackets 38, 38' by placement of bolt 78 through a hole provided in the web of bracket 38, 38' and pivotal attachment of an associated one of the arms 36, 36' to the legs of bracket 38, 38'. The various slots 70, 72 and holes 74 are provided in adapter plate 40, 40' to permit attachment of the spacing brackets 42, 42' to adapter plate 40, 40' and thus mount the adapter plate 40, 40' on the upper or head end of a McPherson strut M. The adjustment provided by the slots and holes has been found necessary to permit a single adapter plate to be employed with the mounting studs of McPherson struts of various manufacture and as employed on different models of cars currently in use in this country.

As can be readily understood from the above description and from the drawings, an alignment system according to the present invention permits simple and accurate restoration of alignment of non-adjustable front end suspensions to factory specifications, allowing sheet metal to be welded on with proper alignment. Once the stands 16, 16' are properly positioned relative to vehicle V and secured to track 26, the cross bar formed by beam 22 is positioned under the hood (not shown) of vehicle V between stands 16, 16' at the proper height so as to be spaced a distance equal to the vertical projection of the arms 36, 36' from the head ends of the struts M. The sleeves 34, 34' are positioned with the arms 36, 36' secured to respective adapter plates 40, 40' and are then attached to the upper ends of the struts M as by the spacing brackets 42, 42'. One of the collars 44, 44' is secured to beam 22 as by pin 56 and slack is taken out of the connection of the associated sleeve 34, 34' to a respective one of the struts M by adjustment of nut 48, 48' and the associated threaded rod 46, 46'. A measurement between the upper ends of the struts M is taken from a frame dimension chart (not shown) such as provided by the manufacturer, and the motor 58 is attached to the other of the stands 16' as illustrated, and to eye 66', again in the illustrated mode, to pull camber out. If the strut M requires adjustment inwardly, the pull will be set up to be made in the opposite direction. Alignment can be then checked with a conventional alignment gauge G, which is a conventional camber and caster gauge such as manufactured by the "Wheel-O-Matic of America" Company. When strut M is back to factory specifications, the surrounding sheet metal in the wheel well W is welded or bolted in a conventional manner while pressure is continued to be maintained on the strut M.

The foregoing is considered as illustrative only of the principles of the invention. Further, since numerous modifications and changes will readily occur to those skilled in the art, it is not desired to limit the invention to the exact construction shown and described, and accordingly, all suitable modifications and equivalents may be resorted to, falling within the scope of the invention.

We claim:

1. An alignment system for non-adjustable motor vehicle front end suspensions, said system comprising support means anchorable relative to an adjacent vehicle being repaired, connector means movably mounted on the support means for removable connection to an element to be straightened, pull means movably mounted on the support means and connectible to the connector means for biasig the connector means and moving the element being straightened a desired amount, said support means including a pair of stands anchorable on a surface supportig the stands, the stands being arrangeable on opposite sides of a vehicle being repaired, a beam connected to and arranged extending between the stands, said support means further including a continuous anchor track having a slot-forming flange and affixable to the support surface, said track being arranged for surroundingly receiving a vehicle being repaired, each of the stands being provided with tongue means for engaging the slot-forming flange and being restrained from movement toward the vehicle, said connector means including a sleeve slidably disposed on the beam, an arm extending cantilever-fashion from the sleeve and connectible to a strut to be straightened, an adapter plate affixed to a upper end of the strut, said arm being attached to the adapter plate, the adapter plate being provided with a plurality of slots to permit the adapter plate to be employed with struts having various stud spacings on the upper end thereof, the connector means further including a collar slidably mounted on the beam and adjustably attached to the sleeve, the collar provided with an opening and the beam being provided with a plurality of holes, a pin engageable in the opening and a selected one of the holes for restraining the collar, and sleeve, from movement relative to the beam, the collar and sleeve comprising one of a pair of sets of a collar and sleeve, with one of the sets being connected to a respective strut of a pair of struts, and the other of the sets being connected to the other of the struts, with the pulling means including a linear motor pivotally connectible to a one of the stands and to the collar of one of the sets of collar and sleeve for pulling the collar, and associated sleeve, toward the one of the stands to which the motor is connected, the other of the collars being secured to the beam by the pin being inserted in the opening of the collar and a selected one of the holes provided in the beam.

2. An alignment system for non-adjustable motor vehicle front end suspension systems, said alignment system comprising support means anchorable relative to an adjacent vehicle being repaired, connector means movably mounted on the support means for removable connection to an element being straightened, pull means movably mounted on the support means and connectible to the connector means for biasing the connector means and moving the element being straightened a desired amount, said support means including a pair of stands anchorable on a support surface supporting the stands, the stands being arrangeable on opposite sides of the vehicle being repaired, a beam connected to and arranged extending between the stands, said connector means including a sleeve slidably disposed on the beam, an arm extending cantilever-fashion from the sleeve and connectible to a strut to be straightened, an adapter affixed to an upper end of the strut, said arm being attached to the adapter plate, the adapter plate being provided with a plurality of slots to permit the adapter plate to be employed with struts having various stud spacings on the upper end thereof, the connector means further including a collar slidably mounted on the beam and adjustably attached to the sleeve, the collar being provided with an opening and the beam being provided with a plurality of holes, a pin engageable in the opening and a selected one of the holes for restraining the collar, and sleeve, from movement relative to the beam, the collar and sleeve comprising one of a pair of sets of a collar and a sleeve with one of the sets being connected to a respective strut of a pair of struts, the other of the sets being connected to the other of the struts, with the pulling means including a linear motor pivotally connectible to a one of the stands and to the collars of one of the sets of collars for pulling the collar, and associated sleeve, toward the one of the stands to which the motor is connected, the other of the collars being secured to the beam by the pin being inserted in the opening of the collar and a selected one of the holes provided in the beam.

3. An alignment assembly or non-adjustable motor vehicle front end suspensions of the type including upper opposite side suspension strut anchor point defining sheet portions to which the upper ends of suspension struts are anchored, said assembly including a pair of upright stands being arrangeable in horizontally spaced relation, a generally horizontal beam extending between and supported in elevated position from said stands for vertical adjustment relative thereto and with said beam at an elevation enabling the front end of a motor vehicle to be forwardly advanced into position closely beneath said beam and opposite end portions of the latter generally centered over said sheet metal portions, a pair of first and second followers carried by said beam end portions and longitudinally adjustable therealong, at least said first followers and said beam including coacting structure for releasably retaining said first follower in adjusted position on said beam, said followers each including depending which extend below said beam means for releasable anchoring to a corresponding sheet metal portion and the associated strut, and thrust developing means operatively connected between one of said stands and the second follower for shifting said second follower along said beam relative to said first follower, the lower ends of said upright stands including means for anchoring relative to a floor surface upon which said upright stands are supported and from which said vehicle may be supported between said upright stands.

4. A method for straightening first and second forward opposite side sheet metal portions of a motor vehicle having the upper ends of corresponding first and second front wheel suspension struts of that vehicle anchored relative thereto, comprising the steps of:

(a) relatively positioning an elongated horizontal beam and said vehicle with opposite end portions of said beam closely spaced above said sheet metal portions;

(b) anchoring said beam relative to a floor surface which supports said vehicle;

(c) releasably anchoring the first sheet metal portion and first strut to an adjacent portion of said beam;

(d) slidably attaching the second sheet metal portion and second strut to an adjacent portion of said beam; and (e) adjustably displacing said second sheet metal portion and second strut relative to said beam and said first sheet metal portion and first strut in a direction generally paralleling said beam.

* * * * *